US011317703B2

(12) United States Patent
Vinson

(10) Patent No.: US 11,317,703 B2
(45) Date of Patent: May 3, 2022

(54) ENERGIZED BELT FOR HOLDING TOOLS

(71) Applicant: Ronald Vinson, Manhattan, IL (US)

(72) Inventor: Ronald Vinson, Manhattan, IL (US)

( * ) Notice: Subject to any disclaimer, the term of this patent is extended or adjusted under 35 U.S.C. 154(b) by 0 days.

(21) Appl. No.: 16/889,937

(22) Filed: Jun. 2, 2020

(65) Prior Publication Data

US 2020/0383459 A1 Dec. 10, 2020

Related U.S. Application Data

(60) Provisional application No. 62/857,109, filed on Jun. 4, 2019.

(51) Int. Cl.

| | |
|---|---|
| ***A45F 5/02*** | (2006.01) |
| ***A45F 3/14*** | (2006.01) |
| *A45F 3/00* | (2006.01) |

(52) U.S. Cl.

CPC ..... *A45F 5/021* (2013.01); *A45F 3/14* (2013.01); *A45F 2003/003* (2013.01); *A45F 2003/144* (2013.01); *A45F 2200/0575* (2013.01)

(58) Field of Classification Search

CPC ..... A45F 5/021; A45F 3/14; A45F 2003/003; A45F 2003/144; A45F 2200/0575

See application file for complete search history.

(56) References Cited

U.S. PATENT DOCUMENTS 3,748,436 A * 7/1973 Cossaboom ..... H05B 3/342 219/211
4,450,495 A * 5/1984 Naruki ..... H01M 50/213 360/137
4,533,821 A * 8/1985 Sato ..... H05B 3/342 219/545
4,569,465 A * 2/1986 O'Farrell ..... A45C 1/04 224/251
4,798,539 A * 1/1989 Henry ..... A61H 23/0236 224/236
4,819,846 A * 4/1989 Hannemann ..... A45F 5/00 2/312
4,863,084 A * 9/1989 Nabozny ..... A41D 19/0068 224/673
4,916,594 A * 4/1990 Headley ..... A45F 3/14 307/150
5,148,002 A * 9/1992 Kuo ..... H01Q 1/273 219/211
5,148,549 A * 9/1992 Sydor ..... A45F 3/14 128/845

(Continued)

*Primary Examiner* — Brian D Nash
(74) *Attorney, Agent, or Firm* — Daniel Zamudio

(57) ABSTRACT

An energized belt for holding tools that has at least one strap and at least one holder. It has an energy processor, a first conductor, a second conductor, a switch and at least one port. The first conductor is attached to the at least one strap and the energy processor is electrically connected to that first conductor. The second conductor is attached to the at least one holder which is attached to the at least one strap and is electrically connected to the first conductor. The switch is electrically connected to the energy processor. The second conductor is capable of emitting heat so that the at least one of the at least one holders as a pouch is suitable for placement of a wearer's hands to be warmed. The at least one port being integrally attached to the at least one holder and connected to the first conductor.

8 Claims, 3 Drawing Sheets

(56) References Cited

U.S. PATENT DOCUMENTS 5,353,975 A * 10/1994 Libertucci ..... A45C 1/04 224/662
5,866,881 A * 2/1999 Jones, III ..... A41D 13/0051 219/527
5,891,189 A * 4/1999 Payne, Jr. ..... A61F 7/007 607/108
5,913,834 A * 6/1999 Francais ..... H04R 5/023 600/591
6,016,944 A * 1/2000 Girbert ..... A45F 3/14 224/250
6,710,312 B2 * 3/2004 Bieker ..... H05B 3/34 219/528
6,888,111 B1 * 5/2005 Tobin ..... A41D 13/0051 219/211
9,364,063 B1 * 6/2016 Dandia ..... G08B 13/126
10,631,606 B1 * 4/2020 Thompson ..... A45F 5/02
10,727,457 B2 * 7/2020 Thiel ..... A41D 1/04
2005/0017680 A1 * 1/2005 Zhao ..... A45F 5/02 320/112
2006/0112723 A1 * 6/2006 Shelton ..... F25D 31/007 62/457.5
2007/0009117 A1 * 1/2007 Laflamme ..... G09F 27/00 381/124
2008/0277441 A1 * 11/2008 Zimmermann ..... A45C 15/00 224/575
2009/0070967 A1 * 3/2009 Gonzalez ..... A45C 13/30 24/16 R
2010/0122995 A1 * 5/2010 Thomas ..... A61B 50/31 224/681
2010/0299800 A1 * 12/2010 Jackson, Jr. ..... A41D 13/081 2/69
2011/0101062 A1 * 5/2011 Roberts ..... A45F 3/14 224/677
2012/0080126 A1 * 4/2012 Marcin ..... A45F 3/14 150/109
2012/0120638 A1 * 5/2012 Gonzalez ..... B68C 1/00 362/154
2014/0367440 A1 * 12/2014 Kooyers ..... A41F 1/008 224/660
2015/0173493 A1 * 6/2015 Kax ..... A45F 3/04 224/641
2016/0206084 A1 * 7/2016 Chiang ..... A45F 5/021
2016/0227861 A1 * 8/2016 May ..... A45F 5/021
2018/0084843 A1 * 3/2018 Nicholai ..... A45F 4/08
2018/0132555 A1 * 5/2018 Gonzalez ..... F21V 33/0008
2019/0133307 A1 * 5/2019 Satterfield ..... B25H 3/00
2019/0231054 A1 * 8/2019 Walter ..... A45F 3/047
2020/0305581 A1 * 10/2020 Barklow ..... A41D 13/0007
2021/0005850 A1 * 1/2021 Thiel ..... H01M 50/147

* cited by examiner

ENERGIZED BELT FOR HOLDING TOOLS

CROSS-REFERENCE TO RELATED APPLICATIONS

The present application claims the benefit of U.S. Provisional Patent Application No. 62/857,109 filed on Jun. 4, 2019, the entirety of which is hereby incorporated by reference.

BACKGROUND

Historic peoples learned to use rocks and stones as tools. As time passed ancient people made improvements to the rocks, sharpening, and shaping them to do work previously done by hand. Soon, people learned to work with iron and steel and new tools were formed. Today, most work that was previously done by hand is performed with a tool. However, a worker must still use his hands for holding, guiding, wielding, and generally controlling the actions of these tools.

Workers perform their tasks in all sorts of weather. It is grueling to work in extreme weather conditions, especially cold weather. In fact, it can be dangerous for one's hands to be working in the cold.

Naturally, when it gets cold the body will restrict warmth to the hands and direct warm blood to the vital organs. Add to this situation the need for workers to use hard, often metal, cold surface tools and the dangers increase.

Because of the natural tendency of hands to be less protected in cold, and the need to continue working with cold tools, workers use all sorts of methods for keeping their hands warm while working. Hand warmers in gloves, gloves alone, breathing warm air onto hands, rubbing hands, these are all methods currently used to warm a worker's hands.

There is a need in the industry for an apparatus that can be used to bring an energy source, an necessarily a heat source, near to a worker so it can be easily used to warm cold hands. Such an apparatus should do this without the need for increasing the burden on a worker or making it necessary to add another workpiece to a workers overly abundant tool provision. Additionally, the bringing of the energy source should add functionality in the apparatus for the worker.

SUMMARY

The present invention is directed to an apparatus that satisfies this need. On aspect of the present invention has at least one tool bag type apparatus. The apparatus is embedded, or otherwise incorporated with, a mechanism for providing heat to areas of the tool bag.

According to an embodiment of the present invention, the energized belt for holding tools comprises at least one strap. It is envisioned that the belt could have a thick strap for around a user's waist. There are situations where there may be double straps or even shoulder straps attached to a waist strap. There is at least one holder, an energy processor, a first conductor, and a second conductor.

The first conductor being attached to the at least one strap and the energy processor being electrically connected to the first conductor. The second conductor being attached to the at least one holder. There is the at least one holder being attached to the at least one strap with the second conductor being electrically connected to the first conductor.

An embodiment further comprises a switch, commonly known, that is electrically connected to the energy processor.

Too the first conductor could be integrally attached to a surface of the at least one strap and the second conductor capable of emitting heat.

An embodiment of the present invention has the at least one holder slidably connected to the at least one strap. The at least one holder is a pouch suitable for placement of a wearer's hands. It is removably attached to the at least one strap in on aspect of the present invention.

An embodiment would have the second conductor in contact with the first conductor via at least one conducting snap. Notably, the at least one holders are best if of different sizes and shapes. The energy processor could be attachable and detachable to the at least one strap and could be attached to the at least one holder.

An embodiment of the present invention further comprises an at least one port that is attached to the at least one holder, integrally attached to name one means for doing so. Possibly, the port could be itself a holder that is attached to the at least one strap. The at least one port being electrically connected to the first conductor.

I envision an embodiment of the energized belt for holding tools comprising at least one strap, at least one holder, an energy processor, a first conductor, a second conductor, a switch, and at least one port. The first conductor being attached to the at least one strap and the energy processor being electrically connected to the first conductor. Next is the second conductor being attached to the at least one holder. With the at least one holder being attached to the at least one strap.

The second conductor is electrically connected to the first conductor with the switch being electrically connected to the energy processor. The second conductor being capable of emitting heat, and many other forms of useful energy, and the at least one of the at least one holder being a pouch suitable for placement of a wearer's appendage, hands for instance.

There is the at least one port being integrally attached to the at least one strap and the at least one port being electrically connected to the first conductor. The embodiment can have the first conductor integrally attached to a surface of the at least one strap. Too the at least one holder can be removably attached to the at least one strap.

A feature of the present invention has the second conductor in contact with the first conductor via at least one conducting snap. Each of the at least one holder can be of different sizes and shapes, the energy processor is attachable and detachable to the at least one strap, or the energy processor is attached to the at least one holder.

The energy processor, a battery to name one example, is capable of delivering energy to the at least one strap. This energy creates a temperature change, a heating for example. The heating causes the strap and any holder connected to the strap to also change temperature.

The invention offers certain other beneficial aspects. For instance, the energized belt provides for provision of a heating element where heat is needed, similar to that used on a heating blanket. Too, an energy processor can be an item such as a battery pack, a solar collector, a chemical pack to name a few examples. The purpose being to have a source of energy that can be used to deliver energy to portions of the energized belt for use in various ways. The energized belt's ports are useful for connecting items of all sorts that are used for various functions, USB cables, electrical cables, liquid tubes, or any other myriad connecting items.

More of the other benefits of the energized belt are that the belt allows for energy to travel throughout the energized belt. For instance, the conductors may be a grid of fine metal wire mesh that produces heat when energy passes through the grid wires. Also, beneficial because the belt has specially designed materials, it provides that energy, mostly in the form of heat, and is not restricted in its travel throughout energized belt.

Certainly, an embodiment of the apparatus would be easily attachable and detachable to a worker's body, I envision the best example being a tool belt type apparatus.

Other beneficial aspects are that the energized belt can carry tools and also provide temperature changing energy, heating for instance, to the tools. The invention can be a tool bag, a tool sack, a tool caddy, or any such tool carrying device used by workers to carry their tools on their body. The belt can be one piece or several pieces. And, the energized belt is sufficiently efficient at creating heat such that human hands can be warmed in many ways through use of the energized belt. One example is the worker can place hands in the pouches that hold the tools. Too, warmed tools will be warm to the touch when used.

My energized belt provides for many methods for connecting a holder to the strap, for instance holders can slide on, clip on, be sewn on, or manufactured to be part of the strap itself. An embodiment of the belt provides for a connection being made between the strap and the holders. Too, an embodiment of the belt provides for the temperature changing function of the energized belt to be activated or de-activated making the tool belt usable even when weather is comfortable for hands. And, an embodiment of the belt provides for using the energy produced to charge batteries or other energy storage items.

BRIEF DESCRIPTION OF THE SEVERAL VIEWS OF THE DRAWINGS

These and other features, aspects and advantages of the present invention will become better understood with regard to the following description, appended claims, and accompanying drawings where:

DESCRIPTION

Overview.

Figure 1:
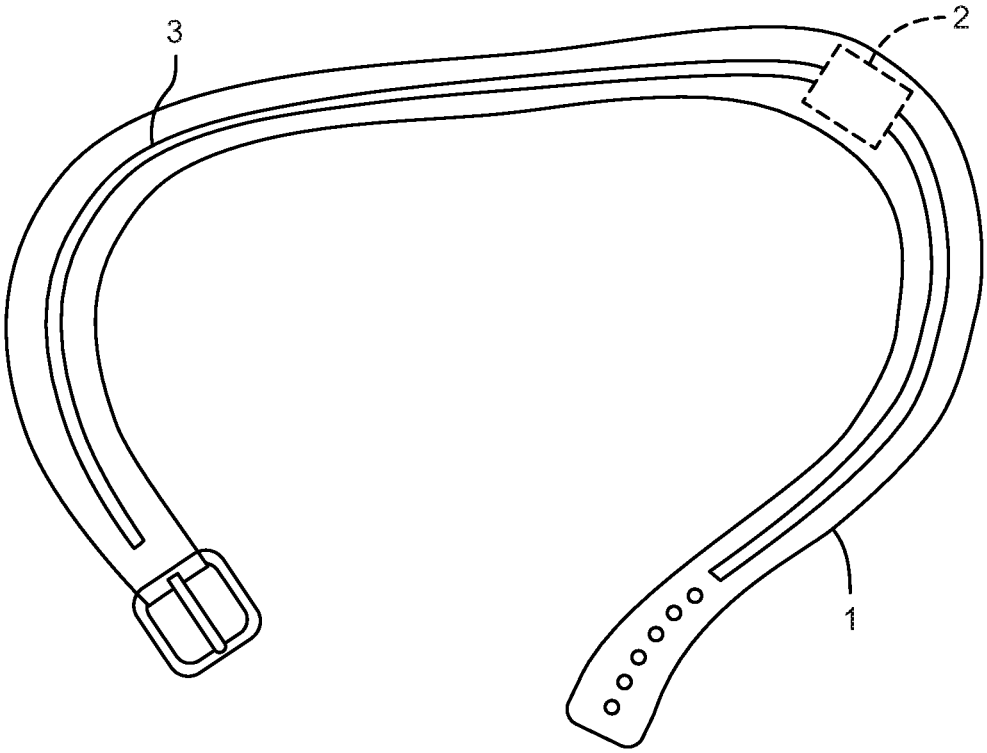
FIG. 1 shows a plan view of a portion of an embodiment of the present invention laid out flat.

As shown in FIG. 1, a plan view of a portion of an embodiment of the present invention laid out flat comprises a strap element 1, a first conductor 3, and an energy processor 2. The first conductor 3 is integral with the strap 1. The energy processor 2 is connected to the first conductor 3.

Figure 2:
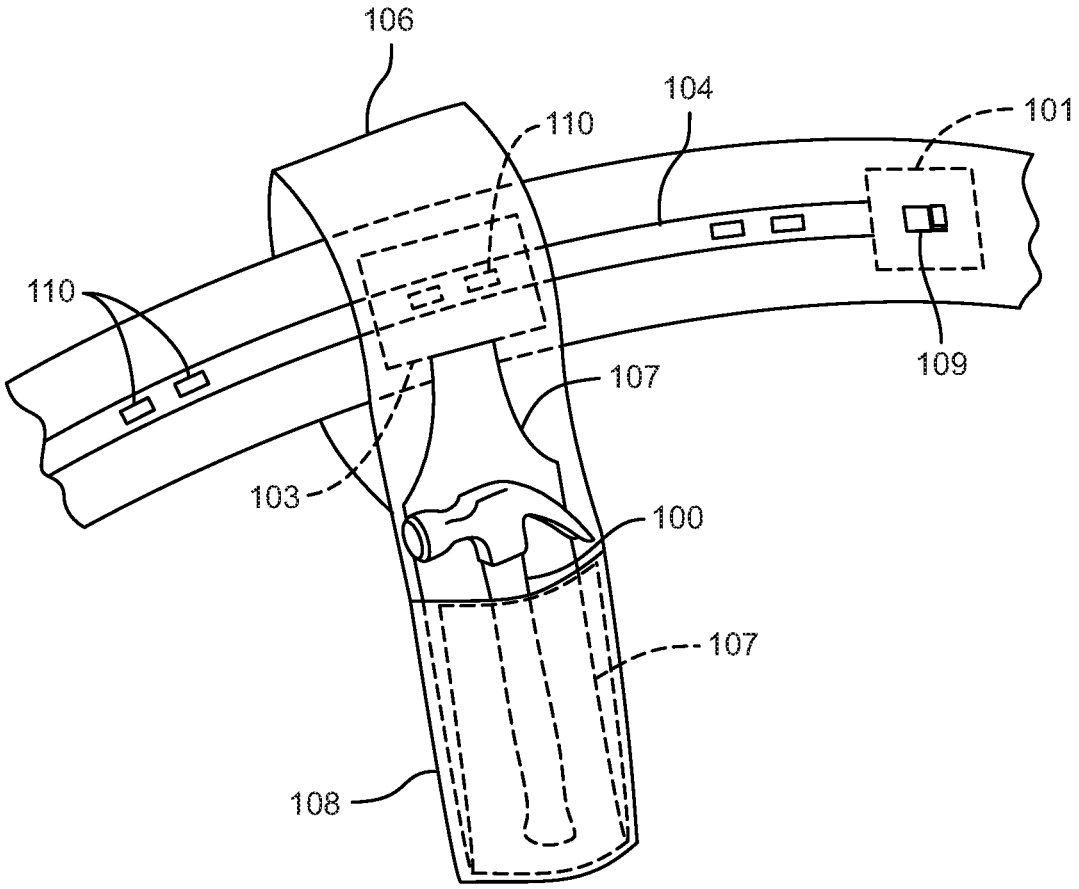
FIG. 2 shows a perspective view of an embodiment of the present invention stowing a hammer.

As shown in FIG. 2, a perspective view of an embodiment of the present invention stowing a hammer comprises an at least one strap 106, a first conductor 104, and an energy processor 101 with a switch 109 electrically attached. The first conductor 104 is integrally attached to the at least one strap 106. The energy processor 101 is connected to the first conductor 104.

The at least one strap has conducting snaps 110 that allow for items to be attached to the at least one strap 106 and electrically to the first conductor 104.

The embodiment has an at least one holder 108 that slides onto the at least one strap 106. Integral to the at least one holder 108 is a second conductor 103. The second conductor 103 is touching the first conductor 104. The second conductor courses, shown by 107, and is integral with the at least one holder 108, substantially at the location where a tool 100 is held by the at least one holder 108. Too, though not shown in this figure, the at least one holder 108 may have ports for making various useful connections. I envision the best example of holder being a pouch similar to that which is customarily seen on toolbelts, an essential feature of the inventive holder is that it be capable of connecting to the at least one strap 106, a simple clip that holds a battery pack is one unusual example.

In such an embodiment, the energy processor 101 can send energy, heat energy for example, through the first conductor 104. That heat energy travels through the first conductor 104 and on to the second conductor 103 and further on coursing 107 through the at least on holder 108. This heats the tool 100 and creates a heated area throughout where a worker can place his or her hands.

Figure 3:
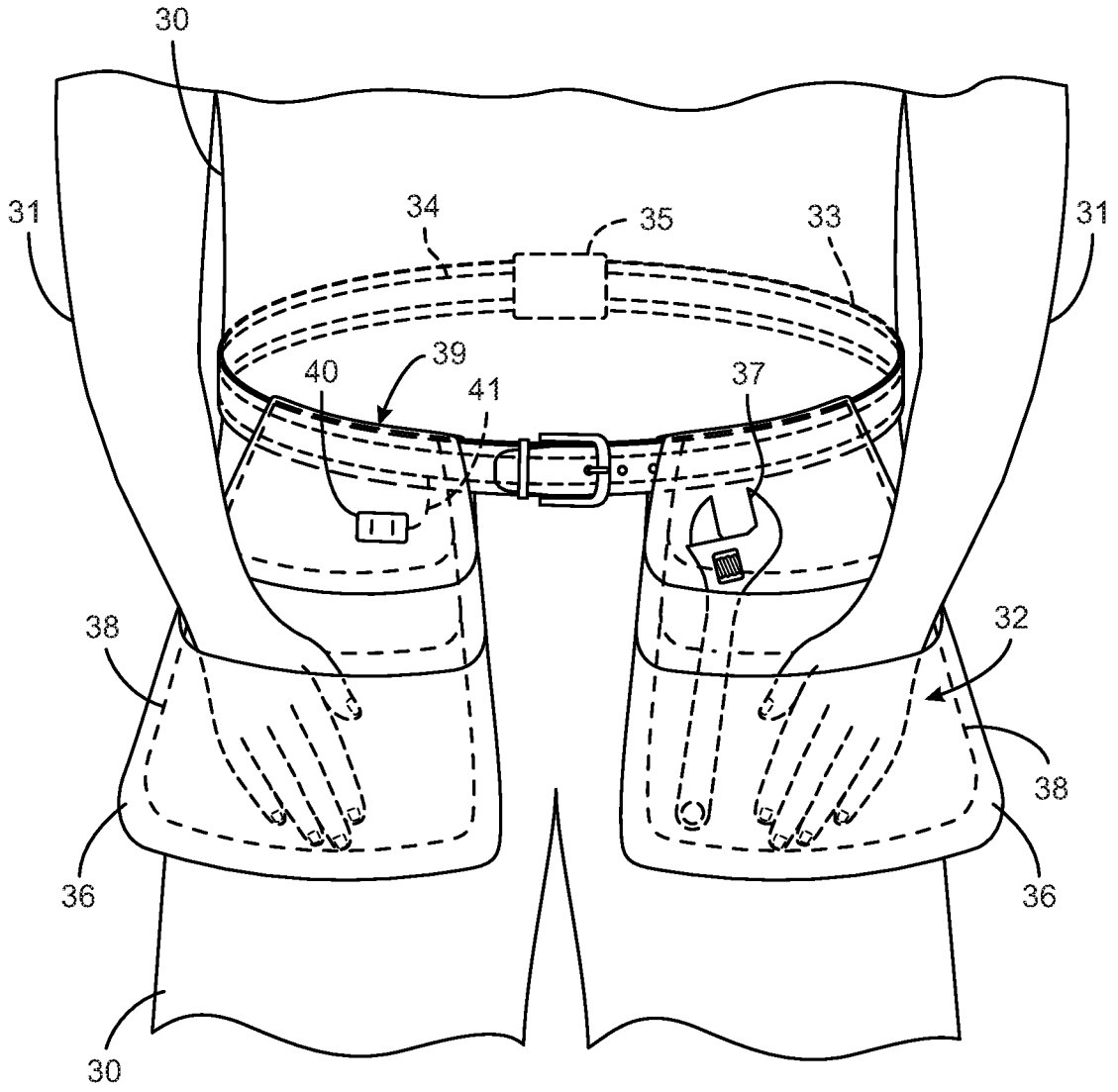
FIG. 3 shows a perspective view of an embodiment of the present invention worn by a user.

As shown in FIG. 3, a perspective view of an embodiment of the present invention worn by a user comprises an at least on strap 33. The at least one strap 33, fitted on the waist of a user 30, has attached to it a first conductor 34 and a switchable (switch not shown) energy processor 35 which is connected to the first conductor 34. I envision there being an at least one holder 36, a pouch for example, with a second conductor 38 attached.

The first conductor 34 and the second conductor 38 are in electrical contact where 39 the at least one holder 36 attaches to the at least one strap 33. In such an embodiment, the connection is made either by the closeness and gravity or even by conducting snaps 110.

The energy made by the energy processor 35 causes the at least one holder 36 to increase in temperature. A user 30 can place his or her appendage 31 in the pouch 32. Also, a tool 37 located in the pouch will become heated. The same energy used for heating can be used for many other purposes. For example, the at least one holder 36 has a port 40 that connects to the conductors 41. Such a port can be used for many purposes.

Although the present invention has been described in considerable detail with the reference to certain preferred versions thereof, other versions are possible. For instance, the belt may be placed elsewhere than around a worker's waste, such as strapped over a worker's shoulders. Therefore, the spirit and scope of the appended claims should not be limited to the description of the preferred versions contained herein.

Any element in a claim that does not explicitly state "means for" performing a specified function, or "step for" performing a specific function, is not to be interpreted as a "means" or "step" clause as specified in 35 U.S.C. § 112, ¶6. In particular, the use of "step of" in the claims herein is not intended to invoke the provisions of 35 U.S.C. § 112, ¶6.

I claim:

1. An energized belt for holding tools, the energized belt comprising:

at least one strap;

at least one holder;

an energy processor;

a first conductor;

a second conductor;

a switch;

at least one port;

the first conductor being attached to the at least one strap;

the energy processor being electrically connected to the first conductor;

the second conductor being attached to the at least one holder;

the at least one holder being attached to the at least one strap;

the second conductor being electrically connected to the first conductor;

the switch being electrically connected to the energy processor;

the second conductor being capable of emitting heat;

at least one of the at least one holders being a pouch suitable for placement of a wearer's hands;

the at least one port being integrally attached to the at least one holder;

the at least one port being electrically connected to the first conductor.

2. The energized belt of claim 1 wherein the first conductor is integrally attached to a surface of the at least one strap.

3. The energized belt of claim 1 wherein the at least one holder is removably attached to the at least one strap.

4. The energized belt of claim 1 wherein the second conductor is in contact with the first conductor via at least one conducting snap.

5. The energized belt of claim 1 wherein the at least one holders are of different sizes and shapes.

6. The energized belt of claim 1 wherein the energy processor is attachable and detachable to the at least one strap.

7. The energized belt of claim 1 wherein the energy processor is attached to the at least one holder.

8. An energized belt for holding tools, the energized belt comprising:

at least one strap;

at least one holder;

an energy processor;

a first conductor;

a second conductor;

the first conductor being attached to the at least one strap;

the energy processor being electrically connected to the first conductor;

the second conductor being attached to the at least one holder;

the at least one holder being attached to the at least one strap;

the second conductor being electrically connected to the first conductor;

a switch;

the switch being electrically connected to the energy processor;

the first conductor being integrally attached to a surface of the at least one strap;

the second conductor being capable of emitting heat;

the at least one holder being slidably connected to the at least one strap;

at least one of the at least one holders being a pouch suitable for placement of a wearer's hands;

the at least one holder being removably attached to the at least one strap;

the second conductor being in contact with the first conductor via at least one conducting snap.

* * * * *